US009891644B1

(12) United States Patent
Ming et al.

(10) Patent No.: US 9,891,644 B1
(45) Date of Patent: Feb. 13, 2018

(54) LOW-DROPOUT REGULATOR WITH DYNAMIC POLE TRACKING CIRCUIT FOR IMPROVED STABILITY

(71) Applicant: UNIVERSITY OF ELECTRONIC SCIENCE AND TECHNOLOGY OF CHINA, Chengdu (CN)

(72) Inventors: Xin Ming, Chengdu (CN); Tiansheng Li, Chengdu (CN); Jun Xu, Chengdu (CN); Zhuo Wang, Chengdu (CN); Bo Zhang, Chengdu (CN)

(73) Assignee: UNIVERSITY OF ELECTRONIC SCIENCE AND TECHNOLOGY OF CHINA, Chengdu (CN)

( * ) Notice: Subject to any disclaimer, the term of this patent is extended or adjusted under 35 U.S.C. 154(b) by 0 days.

(21) Appl. No.: 15/387,678

(22) Filed: Dec. 22, 2016

(30) Foreign Application Priority Data

Aug. 9, 2016 (CN) ..... 2016 1 0650088

(51) Int. Cl.
*G05F 1/575* (2006.01)
*G05F 1/563* (2006.01)
*G05F 1/565* (2006.01)

(52) U.S. Cl.
CPC ..... *G05F 1/575* (2013.01); *G05F 1/563* (2013.01); *G05F 1/565* (2013.01)

(58) Field of Classification Search
CPC ... G05F 1/10; G05F 1/46; G05F 1/461; G05F 1/462; G05F 1/467; G05F 1/56; G05F 1/561; G05F 1/563; G05F 1/565; G05F 1/575
USPC ..... 323/269–277, 279–281
See application file for complete search history.

(56) References Cited

U.S. PATENT DOCUMENTS

2006/0012356 A1* 1/2006 Kase ..... G05F 1/575 323/282
2006/0170404 A1* 8/2006 Amrani ..... G05F 1/565 323/282
2006/0192538 A1* 8/2006 Wang ..... G05F 1/575 323/282
2010/0148735 A1* 6/2010 Napravnik ..... G05F 1/575 323/280
2012/0212200 A1* 8/2012 Amer ..... G05F 1/575 323/282

(Continued)

*Primary Examiner* — Timothy J Dole
*Assistant Examiner* — Ivan Laboy Andino
(74) *Attorney, Agent, or Firm* — Matthias Scholl P.C.; Matthias Scholl

(57) ABSTRACT

A low-dropout regulator, including: a dynamic pole tracking circuit having an active load, a voltage-to-current converter, a current amplifier, a bias circuit, a regulating transistor, a first feedback resistor, a second feedback resistor, and a first capacitor. The dynamic pole tracking circuit includes: a first PMOS, a second PMOS, a first resistor, and a second resistor. The voltage-to-current converter includes: a first NMOS, a second NMOS, a third NMOS, a fourth NMOS, a fifth NMOS, a sixth NMOS, a seventh NMOS, an eighth NMOS, a third PMOS, a fourth PMOS, a seventh PMOS, an eighth PMOS. The current amplifier includes: a fifth PMOS, a sixth PMOS, a ninth NMOS, a tenth NMOS, and a third resistor. The bias circuit includes: a ninth PMOS, a tenth PMOS, an eleventh PMOS, an eleventh NMOS, a twelfth NMOS, a thirteenth NMOS, and a fourth resistor.

1 Claim, 5 Drawing Sheets

(56) References Cited

U.S. PATENT DOCUMENTS

| | | | | |
|---|---|---|---|---|
| 2012/0280667 | A1* | 11/2012 | Drebinger | G05F 1/575 323/273 |
| 2013/0271100 | A1* | 10/2013 | El-Nozahi | G06F 1/468 323/280 |
| 2014/0375289 | A1* | 12/2014 | Kronmueller | G05F 1/565 323/280 |
| 2015/0212530 | A1* | 7/2015 | Forejtek | G05F 1/575 323/280 |

* cited by examiner

LOW-DROPOUT REGULATOR WITH DYNAMIC POLE TRACKING CIRCUIT FOR IMPROVED STABILITY

CROSS-REFERENCE TO RELATED APPLICATIONS

Pursuant to 35 U.S.C. §119 and the Paris Convention Treaty, this application claims the benefit of Chinese Patent Application No. 201610650088.0 filed Aug. 9, 2016, the contents of which are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND OF THE INVENTION

Field of the Invention

The invention relates to a low-dropout regulator (LDO).

Description of the Related Art

Loop stability is a key performance index for evaluating low-dropout regulators. Low-dropout regulators employ an equivalent series resistance (ESR) of an output capacitor to compensate the frequency. However, because of the instability of the ESR, the frequency compensation performance of the low-dropout regulators adopting a P-channel metal oxide semiconductor (PMOS) as a pass transistor leaves much to be desired.

FIG. 1 illustrates the open-loop response of a typical low-dropout regulator including a PMOS. The curve chart includes two key poles, a dominant pole (po) and a secondary pole (pG). As the load current changes, the dominant pole drifts greatly while the secondary pole drifts slightly. The pole (pEA) produced by an error amplifier is often outside a bandwidth of the loop. Because of the presence of the ESR, a zero point (zESR) is produced for compensating the phase. In a wide variation range of the load current, the drift of the dominant pole is relatively large, and the change of the ESR with the frequency and the temperature is unpredictable. This leads to difficulty in ensuring the stability of the low-dropout regulator. In addition, the introduction of the ESR leads to the occurrence of a relatively large voltage spike, deteriorating the transient performance of the low-dropout regulator.

SUMMARY OF THE INVENTION

In view of the above-described problems, it is one objective of the invention to provide a low-dropout regulator comprising a dynamic pole tracking (DPT) circuit comprising an active load. The low-dropout regulator of the invention adopts PMOSs having wide load range as pass transistors and is adapted to improve the loop stability and the transient performance.

To achieve the above objective, in accordance with one embodiment of the invention, there is provided a low-dropout regulator, comprising: a dynamic pole tracking circuit comprising an active load, a voltage-to-current converter, a current amplifier, a bias circuit, a regulating transistor, a first feedback resistor, a second feedback resistor, and a first capacitor. A power regulating stage of the low-dropout regulator is formed by the first feedback resistor, the second feedback resistor, and the first capacitor. A source of the regulating transistor is connected to an input voltage, a gate of the regulating transistor is connected to an output of the dynamic pole tracking circuit based on the active load, and a drain of the regulating transistor is connected to one end of the first feedback resistor and one end of the first capacitor and serves as a voltage regulating output end of the low-dropout regulator. A joint of series connection between the first feedback resistor and the second feedback resistor is adopted as a noninverting input terminal of the voltage-to-current converter for inputting a feedback voltage. The other end of the second feedback resistor is grounded, and the other end of the first capacitor is grounded. A difference between the feedback voltage and a reference voltage of an inverting input is amplified and converted into a current by the voltage-to-current converter, the current is output to the current amplifier, and amplified again by the current amplifier and then passes through the dynamic pole tracking circuit based on the active load where voltage drop is produced to regulate a gate-source voltage of the regulating transistor for feedback regulation of an output voltage.

The voltage-to-current converter comprises: a first N-channel metal oxide semiconductor (NMOS), a second NMOS, a third NMOS, a fourth NMOS, a fifth NMOS, a sixth NMOS, a seventh NMOS, an eighth NMOS, a third PMOS, a fourth PMOS, a seventh PMOS, an eighth PMOS. The seventh PMOS and the eighth PMOS are employed as an input pair for voltage-to-current. A gate of the seventh PMOS is connected to the reference voltage from the external. A gate of the eighth PMOS is connected to the feedback voltage, a source of the seventh PMOS and a source of the eighth PMOS are connected to the bias current. A drain of the seventh PMOS is connected to a gate and a drain of the second NMOS, a gate of the first NMOS, a gate of the third NMOS, a gate of the fourth NMOS, and a gate of the fifth NMOS. A drain of the eighth PMOS is connected to a gate and a drain of the sixth NMOS, a gate of the seventh NMOS, a gate of the eighth NMOS, and a drain of the fourth NMOS. A source of the second NMOS is connected to a drain of the third NMOS. A source of the third NMOS is grounded. A source of the fourth NMOS is connected to a drain of the fifth NMOS. A source of the fifth NMOS is grounded. A source of the sixth NMOS is connected to a drain of the seventh NMOS. A source of the seventh NMOS is grounded. A source of the first NMOS is grounded, and a drain of the first NMOS is connected to a gate and a drain of the third PMOS. The gate of the third PMOS is also connected to a gate of the fourth PMOS. A source of the third PMOS and a source of the fourth PMOS are connected to the input voltage to form a basic current mirror connection. A source of the eighth NMOS is grounded and a drain of the eighth NMOS is connected to a drain of the fourth PMOS serving as an output port of the voltage-to-current circuit.

The current amplifier comprises: a fifth PMOS, a sixth PMOS, a ninth NMOS, a tenth NMOS, and a third resistor. A gate and a drain of the fifth PMOS form a short circuit which is connected to a gate of the sixth PMOS. A source of the fifth PMOS and a source of the sixth PMOS are connected to the input voltage. The gate and the drain of the fifth PMOS are connected to the output of the voltage-to-current circuit. A drain of the sixth PMOS is connected to a gate and a drain of the ninth NMOS. The gate of the ninth NMOS is also connected to a gate of the tenth NMOS. A source of the ninth NMOS is grounded via the third resistor. A source of the tenth NMOS is grounded, and a drain of the tenth NMOS serves as an output of the current amplifier.

The dynamic pole tracking circuit comprises: a first PMOS, a second PMOS, a first resistor, and a second resistor. One end of the first resistor is connected to the input voltage and the other end of the first resistor is connected to a source of the first PMOS. A drain of the first PMOS is connected to one end of the second resistor and a source of the second PMOS. A gate of the first PMOS is connected to the other end of the second resistor as well as a gate and a drain of the second PMOS. One end of the first resistor serves as one end of the dynamic pole tracking circuit based on the active load. The gate of the first PMOS, and one end of the second resistor, and a gate and the drain of the second PMOS are connected serving as the other end of the dynamic pole tracking circuit based on the active load.

The bias circuit comprises: a ninth PMOS, a tenth PMOS, an eleventh PMOS, an eleventh NMOS, a twelfth NMOS, a thirteenth NMOS, and a fourth resistor. A gate of the tenth PMOS is grounded, a source of the tenth PMOS is connected to the input voltage, and a drain of the tenth PMOS is connected to a gate of the thirteenth NMOS and a gate of the ninth PMOS. A source and a drain of the thirteenth NMOS are grounded. A source of the ninth PMOS is connected to the input voltage. A drain of the ninth PMOS is connected to a drain of the eleventh PMOS and a gate and a drain of the eleventh NMOS. A gate of the eleventh PMOS is connected to a gate and a drain of the twelfth PMOS. A source of the eleventh PMOS and a source of the twelfth PMOS are connected to the input voltage to form basic current mirror connection. A source of the eleventh NMOS is grounded, a gate of the eleventh NMOS is connected to a gate of the twelfth NMOS. A source of the twelfth NMOS is grounded via the fourth resistor. A bias current is mirrored via the twelfth PMOS.

A stage for regulating and outputting the power of the low-dropout regulator comprises: the regulating transistor, the first feedback resistor, the second feedback resistor, and the first capacitor. An output of a sum circuit is connected to a gate of the regulating transistor as a gate control signal. A source of the regulating transistor is connected to an input voltage, and a drain of the regulating transistor is grounded via series connection to first feedback resistor and the second feedback resistor and serves as a voltage output end of the low-dropout regulator. The first capacitor is connected between the output voltage and the ground. A position between the first feedback resistor and the second feedback resistor serves as a feedback voltage point.

Advantages of the low-dropout regulator according to embodiments of the invention are summarized as follows: the dynamic pole tracking circuit is employed to allow a secondary pole to drifts along with the dominant pole in conditions of different loads to weaken the dependence of the stability on the equivalent series resistance. In the meanwhile, the voltage-to-current converter and the current amplifier are introduced with enhanced transconductance structures to weaken the transient voltage spike produced in load switch.

BRIEF DESCRIPTION OF THE DRAWINGS

The invention is described hereinbelow with reference to the accompanying drawings, in which.

DETAILED DESCRIPTION OF THE EMBODIMENTS

For further illustrating the invention, experiments detailing a low-dropout regulator are described below. It should be noted that the following examples are intended to describe and not to limit the invention.

Figure 1:
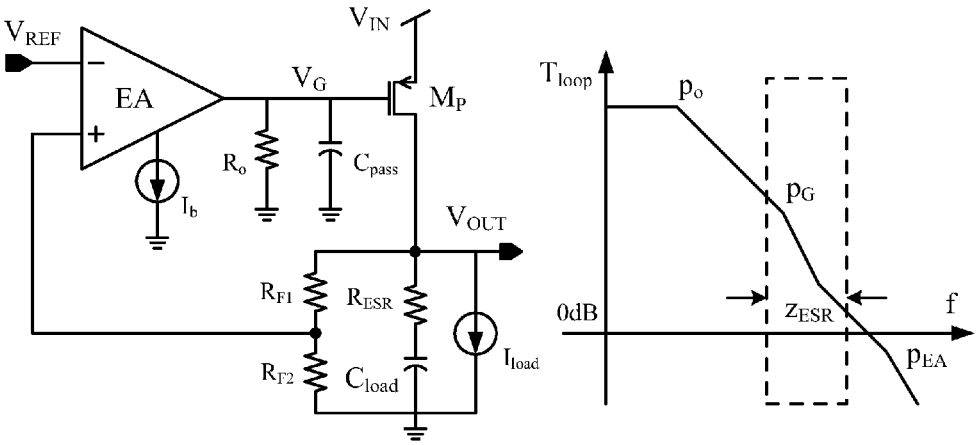
FIG. 1 (Prior art)
FIG. 1 illustrates the open-loop response of a typical low-dropout regulator including a PMOS in the prior art.
Figure 2:
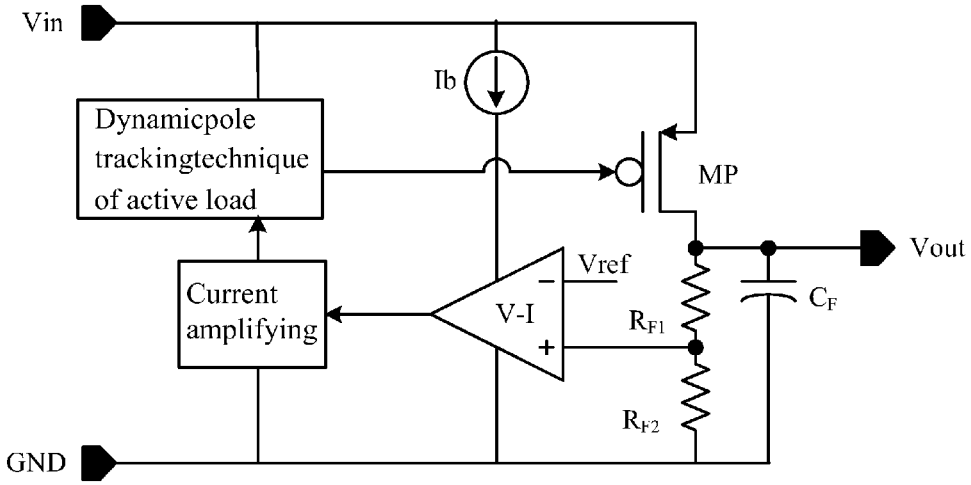
FIG. 2 is a topological structure of a low-dropout regulator adopting dynamic pole tracking technique in accordance with one embodiment of the invention.

A systematic topological structure of a low-dropout regulator possessing high power supply rejection performance of a feedforward noise inhibitory circuit is illustrated in FIG. 2. The structure comprises: a dynamic pole tracking circuit comprising an active load, a current amplifier, a voltage-to-current converter, a bias circuit, and a power regulating stage of the low-dropout regulator. The voltage-to-current converter converts a difference between an output feedback voltage and a reference voltage into an error current. The error current is amplified and passes through the active load to produce a gate-source voltage (VGS) of the regulating transistor MP configured for regulating the power to realize feedback regulation of an output voltage, thus making the output stable.

The secondary pole drifts along with the drift of the dominant pole, therefore the stability of the loop of the system is ensured. This process is realized by the dynamic pole tracking technique of the active load. The active load presents different values in the resistance in conditions of different output load current, which is presented in the switch between the light and heavy loads in the respect of the open-loop response, and the secondary pole changes with the dominant pole to ensure the loop of the system. The process is specifically illustrated combined with specific circuits hereinbelow.

Figure 3:
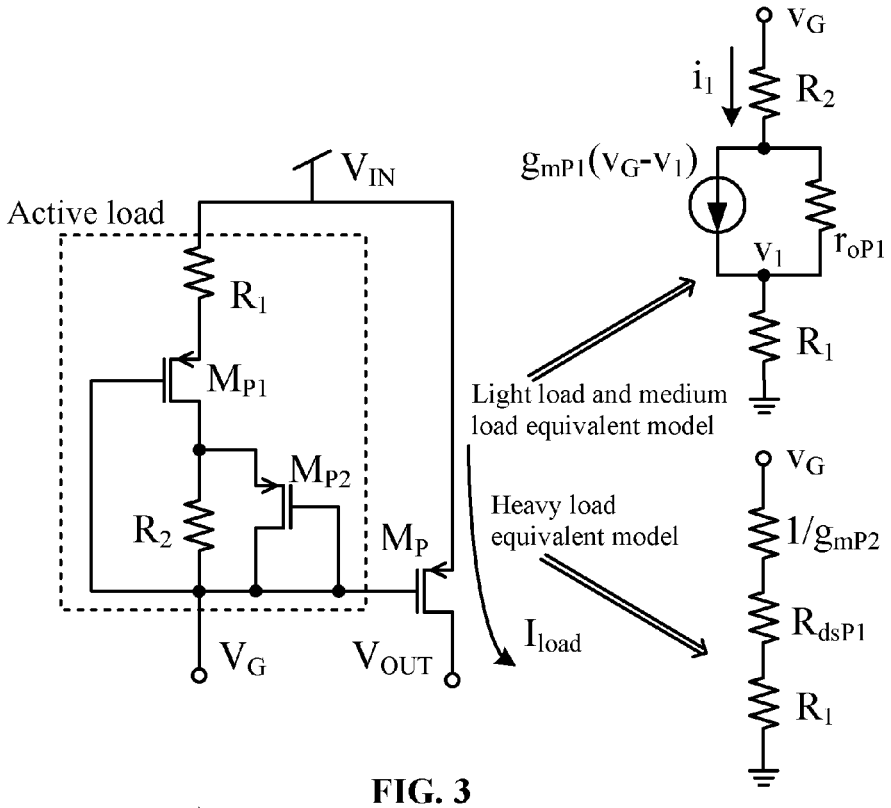
FIG. 3 is a circuit diagram of an active load configured to dynamic pole tracking, a first equivalent model under a light load and medium load, and a second equivalent model under a heavy load in accordance with one embodiment of the invention.

The active load possessing the dynamic pole tracking circuit and the equivalent model are shown in FIG. 3. The dynamic pole tracking circuit of the active load comprises: a first PMOS MP1, a second PMOS MP2, and a first resistor R1, a second resistor R2. One end of the first resistor R1 is connected to the input voltage Vin and the other end of the first resistor R1 is connected to a source of the first PMOS MP1. A drain of the first PMOS MP1 is connected to one end of the second resistor R2 and a source of the second PMOS MP2. A gate of the first PMOS MP1 is connected to the other end of the second resistor R2 as well as a gate and a drain of the second PMOS MP2. One end of the first resistor R1 serves as one end of the dynamic pole tracking circuit of the active load. The gate of the first PMOS MP1, one end of the second resistor R2, and the gate and the drain of the second PMOS MP2 are connected serving as the other end of the dynamic pole tracking circuit of the active load.

Figure 4:
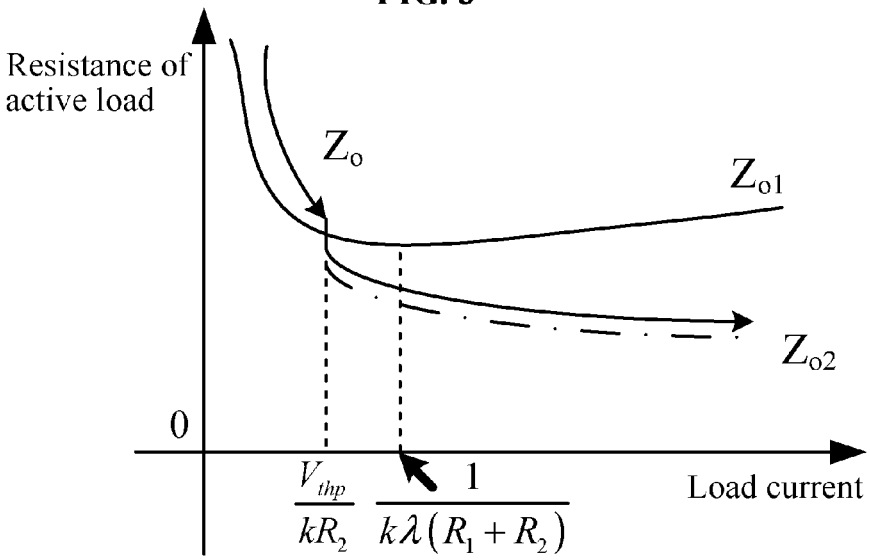
FIG. 4 is a chart showing changes of a resistance of an active load along with a load current in accordance with one embodiment of the invention.
Figure 5:
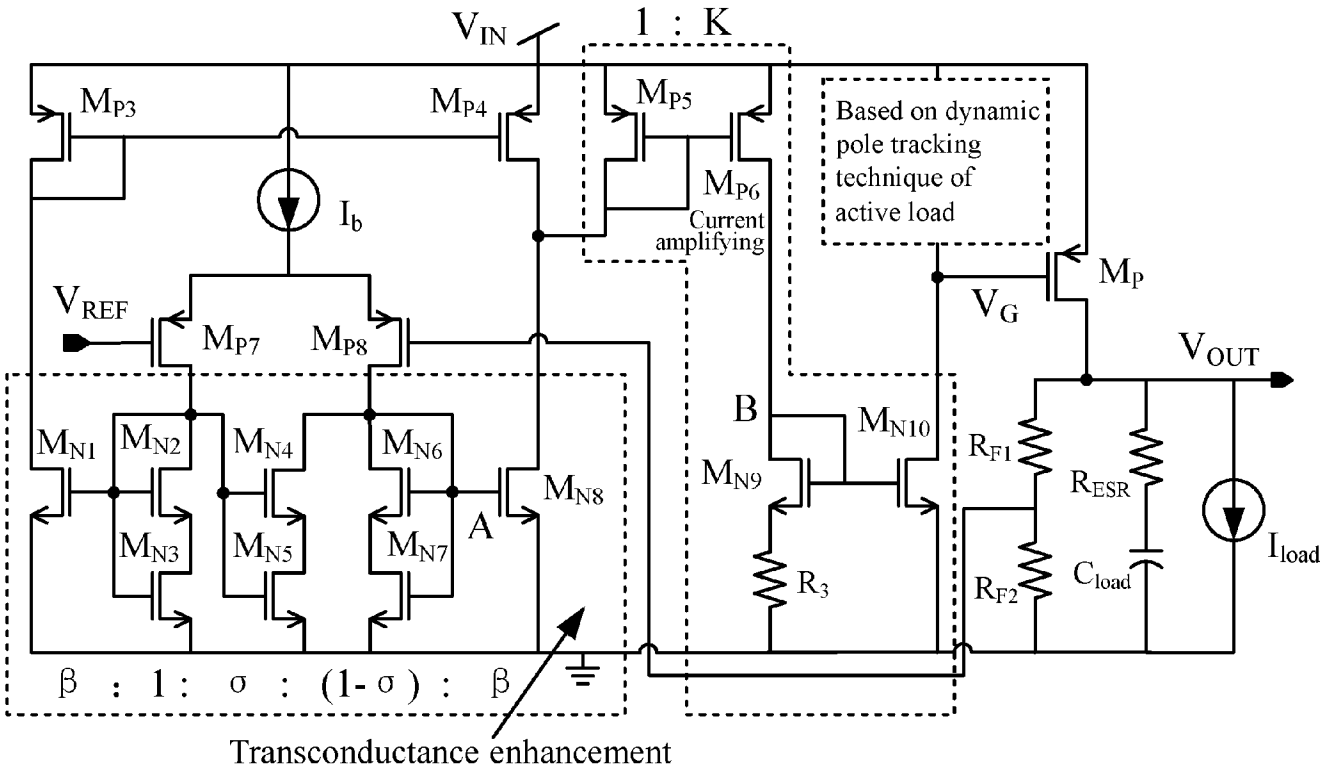
FIG. 5 is a circuit diagram of a key error amplifier of a low-dropout regulator in accordance with one embodiment of the invention.

The active load is connected into the circuit of the low-dropout regulator as follows: one end of the active load connecting to the first resistor R1 is connected to the input voltage Vin, and the other end of the active load is connected to a gate of the regulating transistor MP. According to whether the second PMOS MP2 is opened or turned off, the equivalent models of the active loads in the condition of light load and medium load and in the condition of heavy load are analyzed. Under the first condition of the light load and the medium load, the dropout is too small, and the second PMOS MP2 is turned off. The AC small signal equivalent figure is shown in FIG. 3, which is formed by the second resistor R2 in the vicinity of the gate of the regulating transistor MP, the AC small signal model equivalent to the first PMOS MP1, and the first resistor which are in series connection and grounded. Herein, the resistance is represented by ZO1, a formula of which is:

$$Z_{O1} = \frac{v_G}{i_1} = R_1 + \frac{1}{g_{m1}} + \frac{R_1 + R_2}{g_{m1} r_{o1}}$$

in which, gm1 and ro1 respectively represent a transconductance and an output resistance of small signals of the first PMOS MP1. The first resistor R1 is designed to be much smaller than 1/gm1 to ensure that the dropout produced on the first resistor R1 is much smaller than the gate-source voltage VGS1 of the first PMOS MP1. In calculation, the gate-source voltage VGS1 is approximate to the gate-source voltage VGS, MP of the regulating transistor MP. Assuming that f1=1/gm1 and f2=(R1+R2)/gm1ro1, then variation of the resistance ZO1 is obtained based on derivation of f1 and f2 with respect to the load current ILoad as follows:

$$f_1 = \frac{1}{\sqrt{2k\mu_p C_{ox}(W/L)_1} \cdot \sqrt{I_{load}}}$$

$$\tau_1 = \frac{\partial f_1}{\partial I_{load}} = \frac{-0.5}{\sqrt{2k\mu_p C_{ox}(W/L)_1}} I_{load}^{-1.5}$$

$$f_2 = \frac{\sqrt{k} \cdot \lambda(R_1 + R_2)}{\sqrt{2\mu_p C_{ox}(W/L)_1}} \cdot \sqrt{I_{load}}$$

$$\tau_2 = \frac{\partial f_2}{\partial I_{load}} = \frac{0.5\sqrt{k} \cdot \lambda(R_1 + R_2)}{\sqrt{2\mu_p C_{ox}(W/L)_1}} I_{load}^{-0.5}$$

in which, λ is a factor for regulating a channel length, k is a ratio of a parallel number of the first PMOS MP1 and the regulating transistor MP. The resistance of the second resistor R2 is designed to be much larger than the resistance of the first resistor R1, then the load current ILoad enlarges from 0, f1 reduces from a limited value at a slop of τ1, and f2 enlarges from 0 at a slop of τ2. In the meanwhile, when ILoad=1/kλ(R1+R2), f1=f2, and τ1=τ2. FIG. 4 illustrates the variation of the resistance of the active load in a full load, in which variation of the resistance ZO1 is indicated.

However, due to the existence of the second PMOS MP2, the second PMOS MP2 is started as the load current ILoad enlarges, thus, it is obtained that a critical value of the load current to start the second PMOS MP2 is ILoad=Vthp/kR2. When the load current exceeds the critical value, the second PMOS MP2 is connected to make the second R2 form short circuit, thus, the resistance of the active load is ZO2, formula of which is:

$$Z_{o2} = R_1 + R_{ds1} + \frac{1}{g_{m2}} \square R_1 + \frac{1}{\mu_p C_{ox}} \cdot \left(\frac{1}{(W/L)_1} + \frac{1}{(W/L)_2}\right) \cdot \frac{1}{V_{GSP} - V_{thp}} \propto \frac{1}{\sqrt{I_{load}}}$$

Because VGSP-Vthp is positively proportional to Iload-0.5, the value of the ZO2 reduces with the increase of the ILoad. As shown in FIG. 4, a thick real line indicates the variation of the ZO, with the enlargement of the load current, the resistance of the active load tends to reduce, that is, as the LDO switches from the light load to the heavy load, the dominant pole as well as the secondary pole drifts toward high frequencies, thus ensuring the phase margin, i.e., stability of the loop, of the system.

It is known from the above analyses that the output resistance presented in the error amplifier (EA) (comprising the voltage-to-current converter, the current amplifier, and the active load) is determined by the first resistor R1, which is set to be small in view of a chip area and the small ESR compensation. Compared with the structure of the conventional error amplifier, the gain adjustment of the direct current of the loop is small. To ensure excellent linearity and load regulation, a relative large equivalent Gm is required at a front end. Specific circuits are explained hereinbelow.

The voltage-to-current converting circuit and the current amplifying circuit comprise: a first NMOS MN1, a second NMOS MN2, a third NMOS MN3, a fourth NMOS MN4, a fifth NMOS MN5, a sixth NMOS MN6, a seventh NMOS MN7, an eighth NMOS MN8, a ninth NMOS MN9, a tenth NMOS MN10, a third PMOS MP3, a fourth PMOS MP4, a fifth PMOS MP5, a sixth PMOS MP6, a seventh PMOS MP7, an eighth PMOS MP8, and a third resistor R3. The seventh PMOS MP7 and the eighth PMOS MP8 are employed as an input pair for voltage-to-current. A gate of the seventh PMOS MP7 is connected to the reference voltage Vref from the external. A gate of the eighth PMOS MP8 is connected to the feedback voltage Vfb, a source of the seventh PMOS MP7 and a source of the eighth PMOS MP8 are connected to the bias current Ib. A drain of the seventh PMOS MP7 is connected to a gate and a drain of the second NMOS MN2, a gate of the first NMOS MN1, a gate of the third NMOS MN3, a gate of the fourth NMOS MN4, and a gate of the fifth NMOS MN5. A drain of the eighth PMOS MP8 is connected to a gate and a drain of the sixth NMOS MN6, a gate of the seventh NMOS MN7, a gate of the eighth NMOS MN8, and a drain of the fourth NMOS MN4. A source of the second NMOS MN2 is connected to a drain of the third NMOS MN3. A source of the third NMOS MN3 is grounded. A source of the fourth NMOS MN4 is connected to a drain of the fifth NMOS MN5. A source of the fifth NMOS MN5 is grounded. A source of the sixth NMOS MN6 is connected to a drain of the seventh NMOS MN7. A source of the seventh NMOS MN7 is grounded. A source of the first NMOS MN1 is grounded, and a drain of the first NMOS MN1 is connected to a gate and a drain of the third PMOS MP3. The gate of the third PMOS MP3 is also connected to a gate of the fourth PMOS MP4. A source of the third PMOS MP3 and a source of the fourth PMOS MP4 are connected to the input voltage Vin to form a basic current mirror connection. A source of the eighth NMOS MN8 is grounded and a drain of the eighth NMOS MN8 is connected to a drain of the fourth PMOS MP4 serving as an output port of the voltage-to-current circuit. A gate and a drain of the fifth PMOS MP5 form short circuit, which is connected to a gate of the sixth PMOS MP6. A source of the fifth PMOS MP5 and a source of the sixth PMOS MP6 is connected to the input voltage Vin. A gate and a drain of the fifth PMOS MP5 are connected to the output of the voltage-to-current circuit. A drain of the sixth PMOS MP6 is connected to a gate and a drain of the ninth NMOS MN9. A gate of the ninth NMOS MN9 is connected to a gate of the tenth NMOS MN10. A source of the ninth NMOS MN9 is grounded via the third resistor R3. A source of the tenth NMOS MN10 is grounded, and a drain of the tenth NMOS MN10 serves as an output of the current amplifier.

The voltage-to-current circuit adopts the current subtractor with positive feedback to form a local differential pair to make a current difference between the eighth PMOS MP8 and a path formed by the fourth NMOS MN4 and the fifth NMOS MN5 passes to the path formed by the sixth NMOS MN6 and the seventh NMOS MN7. For example, in conditions of undershoot, the current of the eighth PMOS MP8 increases, while the current of the path formed by the fourth NMOS MN4 and the fifth NMOS MN5 reduces and the output current of the first stage therefore increases. A size ratio of the path formed by the second NMOS MN2 and the third NMOS MN3 to the path formed by the fourth NMOS MN4 and the fifth NMOS MN5 is designed to be 1: σ, and the size ratio of the path formed by the sixth NMOS MN6 and the eighth NMOS MN7 to the path formed by the fourth NMOS MN4 and the fifth NMOS MN5 is designed to be (1−σ): σ, 0<σ<1. Then the equivalent transconductance of the first stage is expressed as follows:

$$G_{m1} = \frac{\beta}{1-\sigma} \cdot g_{m,MP8}$$

The closer σ approaches 1, the larger the equivalent transconductance Gm1 is. The design of σ considers a compromise relation between the value of Gm1 and the stability of the loop. The value of σ is required to satisfy that a parasitic pole produced at a point A is higher than pG of the secondary pole and no large phase shift is produced at the bandwidth. Herein, σ=2/3 and β=4/3.

The current described in the above is further amplified by the current amplifier, and the gain of the current is expressed as follows:

$$A_i = K \cdot \left( \frac{g_{m,MN10}}{g_{m,MN9}} + g_{m,MN10} R_3 \right)$$

In the design, (W/L)MN10=5 (W/L)MN9, and gm, MN10>>gm, MN9. The third resistor R3 is the main source producing the gain. In the design of the current amplifier, the key points are as follows: first, the value of the third resistor R3 exists with a compromise relation between the gain and the loop stability, since a relatively large value of the third resistor R3 make the parasitic pole of the point A towards low frequencies; and second, the bias current of the ninth NMOS MN9 and the tenth NMOS MN10 increases in conditions of large load to ensure enough adjustment gain in condition of decrease of the active load.

Figure 6:
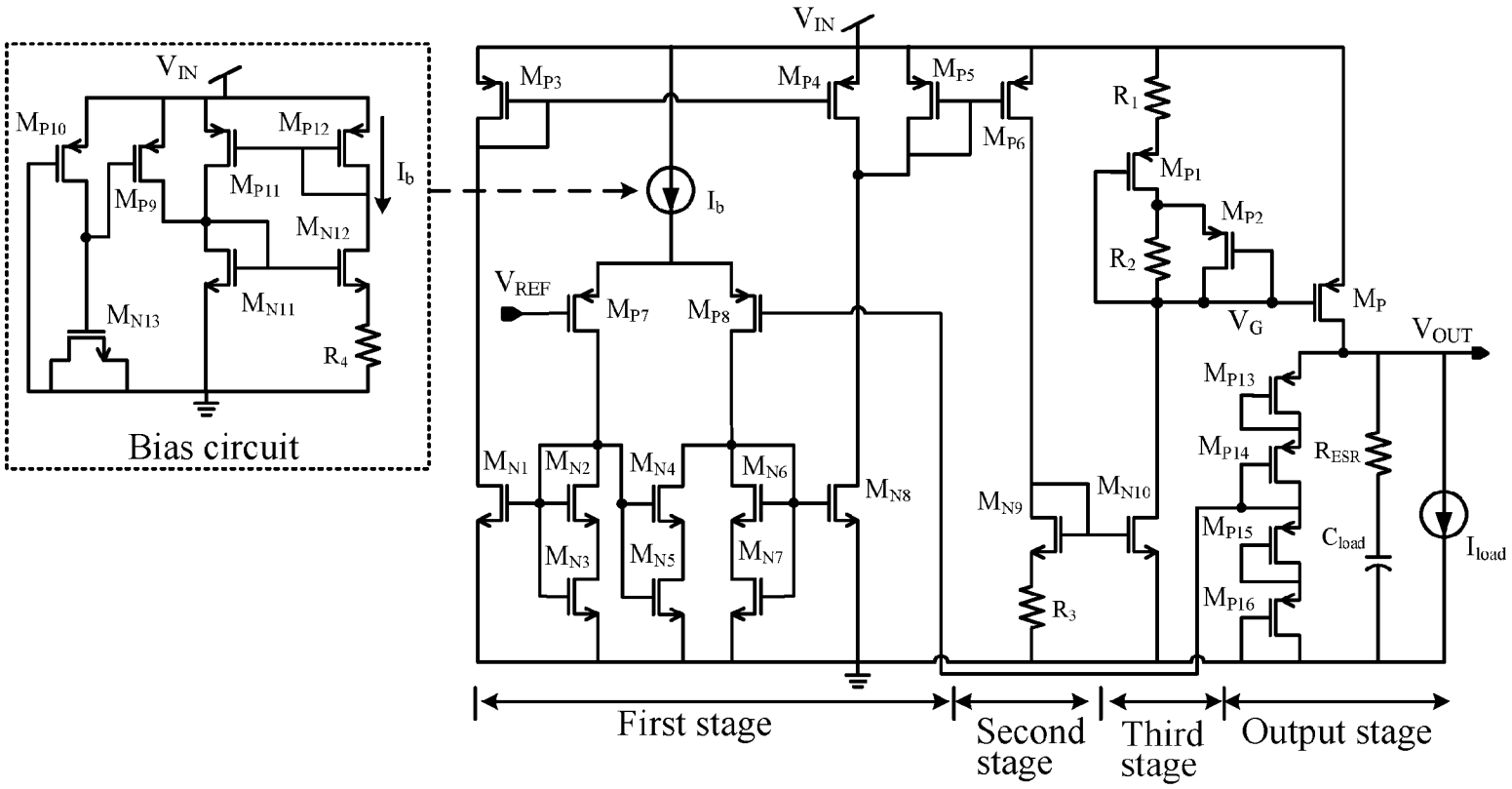
FIG. 6 is a circuit diagram of the whole low-dropout regulator in accordance with one embodiment of the invention.

As shown in FIG. 6, the whole circuit of the low-dropout regulator is illustrated. In practical design, the first feedback resistor RF1 and the second resistor RF2 are formed by the MOSs, and specifically formed by series connection of a thirteenth PMOS MP13, a fourteenth PMOS MP14, a fifteenth PMOS MP15, and a sixteenth PMOS MP16, each of which has the gate and the drain forming short circuit. A source of the thirteenth PMOS MP13 is connected to the output voltage Vout, and a gate and a drain of the thirteenth PMOS MP13 form a short circuit which is connected to a source of the fourteenth PMOS MP14. A gate and a drain of the fourteenth PMOS MP14 form a short circuit which is connected to a source of the fifteenth PMOS MP15 and serves as an output of a feedback voltage of the low-dropout regulator. The feedback voltage of the low-dropout regulator is input into a gate of an operational amplifier MP8. A gate and a drain of the fifteenth PMOS MP15 form a short circuit which is connected to a source of the sixteenth PMOS MP16. A gate and a drain of the sixteenth PMOS MP16 form a short circuit which is grounded. Thus, the chip area is saved.

Figure 7:
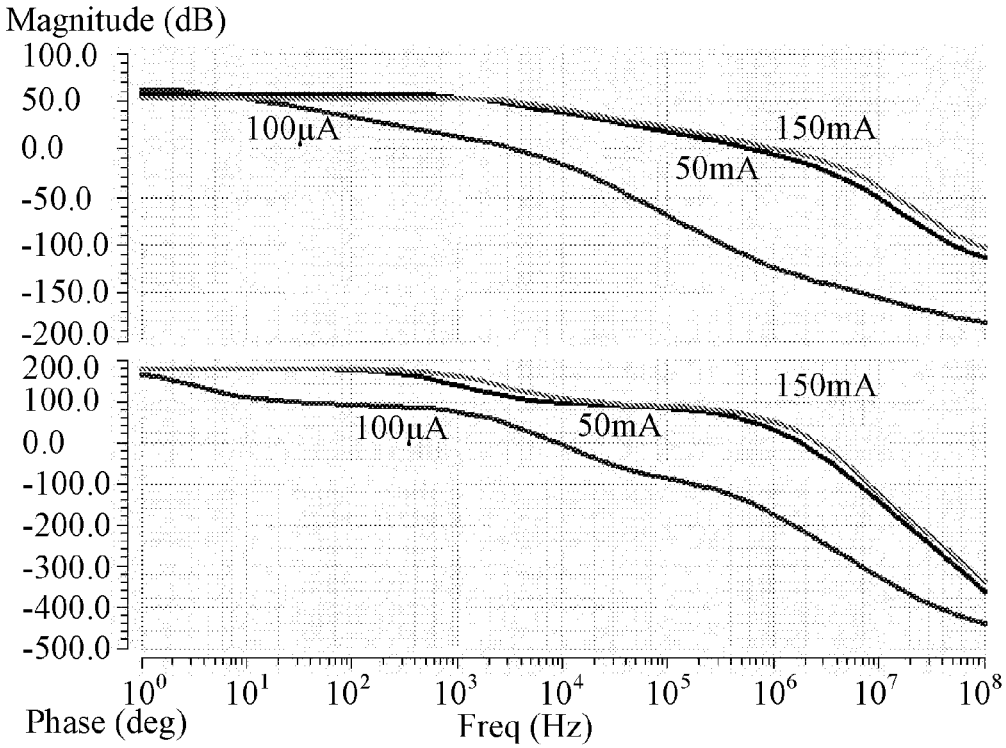
FIG. 7 is charts of an open-loop gain and a phase margin of the low-dropout regulator under different loads in accordance with one embodiment of the invention.
Figure 8:
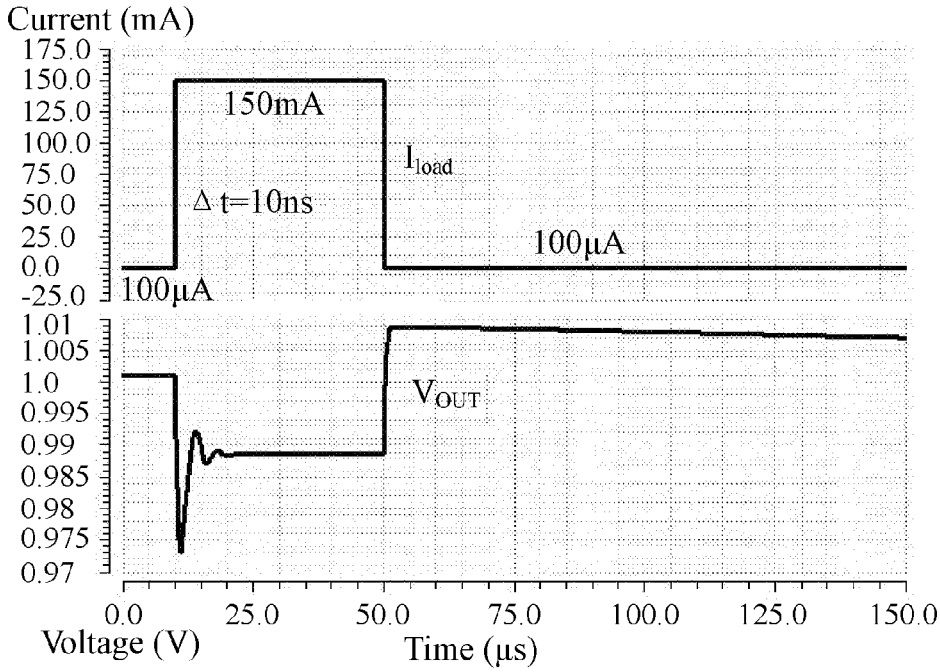
FIG. 8 is a chart of transient response of the low-dropout regulator in a load current within a range of between 100 μA and 150 mA in accordance with one embodiment of the invention.

FIG. 7 is a chart of an open loop response of the low-dropout regulator comprising the dynamic pole tracking circuit based on the active load. It is indicated from the chart that when the active load is introduced, as the load changes, the secondary pole drifts in response to the drift of the dominant pole, so that the loop stability of the system within a wide load range is ensured. FIG. 8 is a chart of transient response of the low-dropout regulator in a load current within a range of between 100 μA and 150 mA, the voltage thereof is 27.5 mV and 7.1 mV in undershoot and overshoot, thus, the low-dropout regulator possesses excellent transient responsive performance.

Unless otherwise indicated, the numerical ranges involved in the invention include the end values. While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A low-dropout regulator, comprising:

A) a dynamic pole tracking circuit comprising an active load, the dynamic pole tracking circuit comprising: a first PMOS, a second PMOS, a first resistor, and a second resistor;

B) a voltage-to-current converter, the voltage-to-current converter comprising: a first NMOS, a second NMOS, a third NMOS, a fourth NMOS, a fifth NMOS, a sixth NMOS, a seventh NMOS, an eighth NMOS, a third PMOS, a fourth PMOS, a seventh PMOS, an eighth PMOS;

C) a current amplifier, the current amplifier comprising: a fifth PMOS, a sixth PMOS, a ninth NMOS, a tenth NMOS, and a third resistor;

D) a bias circuit for generating a bias current, the bias circuit comprising:

a ninth PMOS, a tenth PMOS, an eleventh PMOS, a twelfth PMOS, an eleventh NMOS, a twelfth NMOS, a thirteenth NMOS, and a fourth resistor;

E) a regulating transistor;

F) a first feedback resistor;

G) a second feedback resistor; and

H) a first capacitor;

wherein a power regulating stage of the low-dropout regulator is formed by the first feedback resistor, the second feedback resistor, and the first capacitor; a source of the regulating transistor is connected to an input voltage, a gate of the regulating transistor is connected to an output of the dynamic pole tracking circuit based on the active load, and a drain of the regulating transistor is connected to one end of the first feedback resistor and one end of the first capacitor and serves as a voltage regulating output end of the low-dropout regulator; a joint of series connection between the first feedback resistor and the second feedback resistor is adopted as a noninverting input terminal of the voltage-to-current converter for inputting a feedback voltage; the other end of the second feedback resistor is grounded, and the other end of the first capacitor is grounded; a difference between the feedback voltage and a reference voltage of an inverting input is amplified and converted into a current by the voltage-to-current converter, the current is output to the current amplifier, and amplified again by the current amplifier and then passes through the dynamic pole tracking circuit based on the active load where voltage drop is produced to regulate a gate-source voltage of the regulating transistor for feedback regulation of an output voltage;

the seventh PMOS and the eighth PMOS are employed as an input pair for voltage-to-current; a gate of the seventh PMOS is connected to the reference voltage from the external; a gate of the eighth PMOS is connected to the feedback voltage, a source of the seventh PMOS and a source of the eighth PMOS are connected to the bias current; a drain of the seventh PMOS is connected to a gate and a drain of the second NMOS, a gate of the first NMOS, a gate of the third NMOS, a gate of the fourth NMOS, and a gate of the fifth NMOS; a drain of the eighth PMOS is connected to a gate and a drain of the sixth NMOS, a gate of the seventh NMOS, a gate of the eighth NMOS, and a drain of the fourth NMOS; a source of the second NMOS is connected to a drain of the third NMOS; a source of the third NMOS is grounded; a source of the fourth NMOS is connected to a drain of the fifth NMOS; a source of the fifth NMOS is grounded; a source of the sixth NMOS is connected to a drain of the seventh NMOS; a source of the seventh NMOS is grounded; a source of the first NMOS is grounded, and a drain of the first NMOS is connected to a gate and a drain of the third PMOS; the gate of the third PMOS is also connected to a gate of the fourth PMOS; a source of the third PMOS and a source of the fourth PMOS are connected to the input voltage to form a basic current mirror connection; a source of the eighth NMOS is grounded and a drain of the eighth NMOS is connected to a drain of the fourth PMOS serving as an output port of the voltage-to-current circuit;

a gate and a drain of the fifth PMOS form a short circuit which is connected to a gate of the sixth PMOS; a source of the fifth PMOS and a source of the sixth PMOS are connected to the input voltage; the gate and the drain of the fifth PMOS are connected to the output of the voltage-to-current circuit; a drain of the sixth PMOS is connected to a gate and a drain of the ninth NMOS; the gate of the ninth NMOS is also connected to a gate of the tenth NMOS; a source of the ninth NMOS is grounded via the third resistor; and a source of the tenth NMOS is grounded, and a drain of the tenth NMOS serves as an output of the current amplifier;

one end of the first resistor is connected to the input voltage and the other end of the first resistor is connected to a source of the first PMOS; a drain of the first PMOS is connected to one end of the second resistor and a source of the second PMOS; a gate of the first PMOS is connected to the other end of the second resistor as well as a gate and a drain of the second PMOS; one end of the first resistor serves as one end of the dynamic pole tracking circuit based on the active load; the gate of the first PMOS, and one end of the second resistor, and a gate and the drain of the second PMOS are connected together serving as the other end of the dynamic pole tracking circuit based on the active load; and a gate of the tenth PMOS is grounded, a source of the tenth PMOS is connected to the input voltage, and a drain of the tenth PMOS is connected to a gate of the thirteenth NMOS and a gate of the ninth PMOS; a source and a drain of the thirteenth NMOS are grounded; a source of the ninth PMOS is connected to the input voltage; a drain of the ninth PMOS is connected to a drain of the eleventh PMOS and a gate and a drain of the eleventh NMOS; a gate of the eleventh PMOS is connected to a gate and a drain of the twelfth PMOS; a source of the eleventh PMOS and a source of the twelfth PMOS are connected to the input voltage to form basic current mirror connection; a source of the eleventh NMOS is grounded, a gate of the eleventh NMOS is connected to a gate of the twelfth NMOS; a source of the twelfth NMOS is grounded via the fourth resistor; and the bias current is mirrored via the twelfth PMOS.

* * * * *